US005098480A

United States Patent [19]

McGinnis et al.

[11] Patent Number: 5,098,480

[45] Date of Patent: Mar. 24, 1992

[54] INDUSTRIAL ASPHALTS

[75] Inventors: Edgar L. McGinnis, Moraga; Judson E. Goodrich, Santa Rosa, both of Calif.

[73] Assignee: Chevron Research and Technology Company, San Francisco, Calif.

[21] Appl. No.: 527,419

[22] Filed: May 23, 1990

Related U.S. Application Data

[63] Continuation-in-part of Ser. No. 488,206, Mar. 5, 1990, abandoned, which is a continuation-in-part of Ser. No. 324,473, Mar. 16, 1989, abandoned, said Ser. No. 488,206, is a continuation of Ser. No. 356,816, May 25, 1989, abandoned, which is a continuation of Ser. No. 206,541, Jun. 14, 1988, abandoned, which is a continuation of Ser. No. 948,263, Dec. 31, 1986, abandoned, said Ser. No. 324,473, is a continuation of Ser. No. 147,391, Jan. 25, 1988, abandoned, which is a continuation of Ser. No. 626,188, Jun. 29, 1984, abandoned.

[51] Int. Cl.[5] ..... C08L 95/00

[52] U.S. Cl. ..... 106/273.1; 208/44

[58] Field of Search ..... 106/273.1; 208/44

[56] References Cited

U.S. PATENT DOCUMENTS

| | | | |
|---|---|---|---|
| 1,092,448 | 4/1914 | Melamid | 208/279 |
| 1,968,746 | 7/1934 | Condrup | 208/44 |
| 2,179,208 | 11/1939 | Burk et al. | 208/44 |
| 2,676,910 | 4/1954 | Edson | 208/4 |
| 2,762,755 | 9/1956 | Kinnaird | 208/44 |
| 3,096,192 | 7/1963 | Pitchford | 208/44 |
| 3,120,486 | 2/1964 | Braunwarth et al. | 208/279 |
| 3,126,329 | 3/1964 | Fort | 208/279 |
| 3,130,144 | 4/1964 | Bostick | 208/44 |
| 3,751,278 | 8/1973 | Alexander | 208/34 |

*Primary Examiner*—Theodore Morris
*Assistant Examiner*—Mary C. Dinunzio
*Attorney, Agent, or Firm*—R. C. Gaffney; J. J. DeYoung

[57] ABSTRACT

Disclosed is a method of producing an industrial asphalt from a bituminous material. One preferred embodiment comprises mixing together without air-blowing:

a. a feed material comprising a bituminous material having a viscosity of at least 50 centistokes at 350° F. and wherein said feed material forms a single phase when mixed with 5 percent of 85 percent phosphoric acid; and b. from about 0.1 to 20.0 percent by weight of phosphoric acid, said mixing being done at a temperature in the range of 351° to 600° F., whereby the softening point of the feed is substantially increased and the penetration is significantly decreased.

A second preferred embodiment comprises heating at an elevated temperature a mixture comprising:

1. from about 0.1 to 20.0 percent by weight green phosphoric acid, and 2. a bituminous material to make up 100 percent by weight, said bituminous material comprising asphalt.

17 Claims, 1 Drawing Sheet

INDUSTRIAL ASPHALTS

CROSS REFERENCE TO RELATED APPLICATIONS

This application is a continuation-in-part of Ser. No. 488,206 filed Mar. 5, 1990 now abandoned, and Ser. No. 324,473 filed Mar. 16, 1989 now abandoned. Ser. No. 488,206 is a continuation of Ser. No. 356,816, filed May, 25, 1989 now abandoned, which is a continuation of Ser. No. 206,541, filed Jun. 14, 1988 now abandoned, which is a continuation of Ser. No. 948,263, filed Dec. 31, 1986 now abandoned. Ser. No. 324,473 is a continuation of Ser. No. 147,391, filed Jan. 25, 1988 now abandoned, which is a continuation of Ser. No. 626,188, filed Jun. 29, 1984 now abandoned. The entire disclosures of each of the above-identified applications is incorporated herein by reference.

BACKGROUND OF THE INVENTION

The present invention relates to a method for modifying the physical properties of bituminous materials and to asphalt compositions obtained therefrom. More particularly, the present invention relates to a method of producing industrial asphalts. Industrial asphalts have many uses but are particularly useful in roofing applications.

The physical properties of asphalt vary over a wide range. FIG. 1 is a softening point-penetration plot for various industrial asphalt grades. The four rectangles in FIG. 1 outline the properties of Types I–IV industrial asphalts as defined by the American Society for Testing and Materials (ASTM-D312). The plot illustrates the tremendously varying properties required of industrial asphalts for different applications. Industrial asphalts have softening points above 135° F.

The residue remaining from crude oil after distilling off the various cuts is known as asphalt, or is known as asphalt flux, or simply flux when it is used to make asphalt. Flux is treated in various ways to obtain industrial asphalts having a variety of uses.

The properties of bituminous materials may be modified by such well-known treating means such as solvent extraction, air-blowing and the like. One type of treatment involves air-blowing, with or without a catalyst and with or without a hydrocarbon diluent.

Air-blowing processes using phosphoric acid and other catalysts are known in the art for making industrial asphalts. However, air-blowing processes require complex and expensive air-blowing equipment which must meet ever more stringent air pollution regulations. Furthermore, air-blowing requires long processing times on the order of many hours. Similar products can sometimes be obtained by stirring asphalt at high temperature in the presence of a catalyst. One known catalyst is essentially pure phosphoric acid generally manufactured by the furnace process.

There are two types of phosphoric acid. The first, is pure, water-white phosphoric acid made by reacting $P_4O_{10}$ with water in what is generally called the furnace process. This white phosphoric acid is available in concentrations ranging from very dilute up to about 116 percent. The second is called green phosphoric acid and is the crude phosphoric acid present after precipitation of sulfate by addition of a suitable ion (e.g., $Ca++$) to the sulfuric acid solution of the mineral phosphate. It is not only colored, but contains a few percent of impurities, chiefly dissolved salts. Green phosphoric acid is available in concentrations up to about 94 percent and is made by the wet process.

U.S. Pat. No. 3,751,278 discloses a process for treating asphalts without air-blowing using phosphoric acids having an $H_3PO_4$ equivalent of greater than 100 percent. The compositions produced by this process are directed to paving asphalts particularly useful in highway construction and maintenance. Paving asphalts usually have softening points below 135° F. and penetrations from 20 to 300 dmm at 77° F. This patented process is particularly directed to treating asphalts to substantially increase the viscosity without a significant decrease in penetration.

U.S. Pat. No. 2,179,208 teaches a process for making asphalt which comprises air-blowing in the absence of any catalyst at a temperature of 300° to 500° F. for 1 to 30 hours followed by a second step of heating that material to a temperature greater than 300° F. with a small amount of polymerizing catalysts. The catalysts include phosphoric acid, ferric chloride, $BF_3$, etc. Using small amounts of these catalysts, products with melting points of 140° F. or less were produced. The patent teaches that overall processing times are significantly reduced using this two-step process.

U.S. Pat. No. 2,762,755 teaches a two-step process for producing asphalt which comprises the steps of: (1) treating asphalt with from 1/10 to 10 percent phosphoric acid at a temperature from about 200° F. to about 350° F. for a period of time from 4 hours to ½ hour followed by the second step (2) of oxidizing the product of step (1) at a temperature from about 350° F. to about 450° F. to obtain the desired characteristics for the product asphalt.

U.S. Pat. Nos. 2,676,910 and 2,845,359 teach the use of $P_2O_5$ with the exclusion of air in a process to modify asphalts. These patents are particularly directed at producing asphalts for canal linings or cutback asphalts.

U.S. Pat. No. 1,092,448 teaches a method of treating mineral oil with phosphoric acid at a temperature of approximately 300° C. (572° F.) to produce purified oils.

One object of the present invention is to produce an industrial asphalt in a simple one step process without any prior air-blowing treatment of the bituminous material feed stock or any post air-blowing treatment of the asphalt formed.

A second object of the present invention is to provide a process for producing industrial asphalts where treatment times are very short when compared to conventional air-blowing processes.

Another object of the present invention is to provide a process which can utilize as a feed, bituminous material which heretofore could not be used in making industrial asphalts by the prior art air-blowing process without the addition of substantial amounts of lower boiling hydrocarbons.

Another object of the present invention is to produce an industrial asphalt from green phosphoric acid that is not producible from white phosphoric acid.

Another object of the present invention is to produce an industrial asphalts having low viscosities.

Another object of the present invention is to produce an asphalt shingles containing high levels of fillers.

Other objects will be readily apparent to those skilled in the art from a reading of this specification.

BRIEF DESCRIPTION OF THE FIGURE

The sole FIGURE is a softening point-penetration plot for various industrial asphalt grades.

SUMMARY OF THE INVENTION

Figure 1:
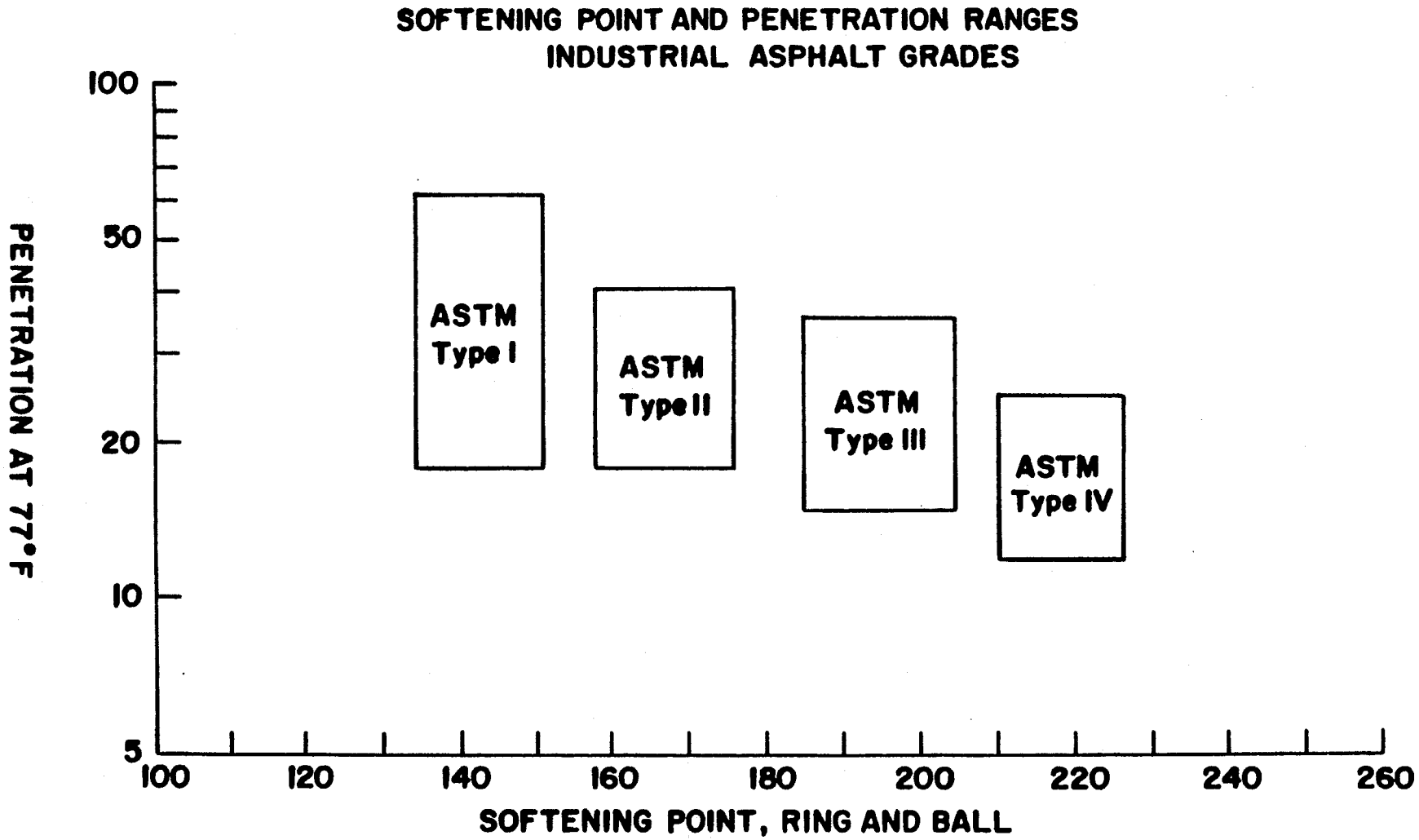

The present invention involves a method of producing an industrial asphalt from a bituminous material. One embodiment comprises mixing together without air-blowing:

(a) a feed material comprising a bituminous material having a viscosity of at least 50 centistokes at 350° F. and wherein the feed bituminous material forms a single phase when mixed with 5 percent of 85 percent phosphoric acid; and (b) from about 0.1 to 20.0 percent by weight of phosphoric acid, said mixing being done at a temperature in the range of 351° to 600° F., whereby the softening point of the feed is substantially increased and the penetration is significantly decreased.

A second embodiment comprises heating at an elevated temperature a mixture comprising:

1. from about 0.1 to 20.0 percent by weight green phosphoric acid, and
2. a bituminous material to make up 100 percent by weight, said bituminous material comprising asphalt.

DETAILED DESCRIPTION OF THE INVENTION AND PREFERRED EMBODIMENTS

First Preferred Embodiment of the Invention

In a first preferred embodiment of the invention industrial asphalts are prepared by starting with particular bituminous materials and mixing them without air-blowing with phosphoric acid to produce industrial asphalt. The product industrial asphalts are formed in a one step process without any air-blowing or other oxidation treatment of the bituminous material prior to or after treatment with phosphoric acid.

Feeds suitable for use in the this first embodiment are called bituminous materials ("Bituminous Materials: Asphalts, Tars, and Pitches" Vol. I, A. J. Hoiberg, Editor, 1964, Interscience, pages 2-5), the disclosure of which is incorporated herein by reference, can be of varied character. Many petroleum residua (also known as fluxes) remaining following the separation of vaporizable hydrocarbons from oil fractions or any relatively high molecular weight extract obtained from petroleum refining or from naturally occurring hydrocarbons, including tar and Gilsonite, can be used.

It is critical for the one-step process of the present invention that the bituminous material feed stock have the following two characteristics:

1. A viscosity of at least 50 centistokes when measured at 350° F.; and
2. Forms a single phase when mixed with 5 percent of 85 percent phosphoric acid. It has been surprisingly found that feed stocks not meeting this critical parameter will not form industrial asphalts utilizing the simple one-step process of the present invention.

Generally the feed will have an initial viscosity at 350° F. of at least 50 cSt. In the process of the first embodiment, the softening point is substantially increased and the penetration point is significantly decreased thereby producing industrial asphalts. Generally, the feed flux will have a softening point in the range of 100° F. to 200° F., preferably 110° F. to 150° F., a penetration in the range 30 to 150, preferably 40 to 100 dmm at 77° F. Generally, the viscosity of the feed is 50 to 200 cSt and more preferably 65 to 180 cSt. Particularly preferred feed materials include: petroleum distillation residue, a blend of hard petroleum distillation residue, a blend of Gilsonite, a blend of pitch from a solvent deasphalting process, a blend of pitch from a supercritical solvent deasphalting process. Any of the above blends can contain petroleum distillate or vegetable oil diluents.

One surprising feature of the first embodiment resides in the finding that by the critical selection of the bituminous material feed, one can produce industrial asphalts in a simple one-step process without prior or post-treatments involving air-blowing, characteristic of prior art processes.

The bituminous material feed stock is mixed with 0.1 to 20.0 percent by weight, preferably 0.5 to 10.0 percent and more preferably more than 3.5, and still more preferably more than 5.0, and less than 8.0 percent by weight of phosphoric acid. The quantity of phosphoric acid to be utilized in the first embodiment is inversely proportional to the viscosity of the feed material. Thus, feed stocks having low viscosities, e.g., about 60 cSt. at 350° F., require larger amounts of acid, e.g., about 8%. On the other hand, feed stocks having high viscosities, e.g., about 200 cSt. at 350° F., need relatively lower amounts of acid, e.g., about 0.5 or 2%. Phosphoric acid is readily available commercially and will generally have an $H_3PO_4$ equivalent of 50 to 115 percent. Most preferred for use in the first embodiment are phosphoric acids having an $H_3PO_4$ equivalent of less than 100 percent and preferably in the range of 70 to 90 percent.

The treating method of the first embodiment comprises heating the feed stock to a temperature in the range 351° F. to 600° F., preferably 400° F. to 500° F. to facilitate mixing and reacting with the phosphoric acid. The heating temperature will generally at all times be maintained below the flash point of the feed stock.

After the starting material has been heated to a temperature sufficient for mixing purposes, at least above its softening point, the phosphoric acid is most often introduced into the hot feed with continuous agitation. Agitation is usually supplied by mechanical means and must be adequate to disperse the phosphoric acid intimately throughout the asphalt. A preferred alternative process for mixing involves the use of in-line blending and a static mixer which further facilitate very short mixing and reaction time.

In the first embodiment of the invention the treating of the bituminous material does not include air-blowing of the feed stock during mixing or as a part of the treatment, the treatment being carried out without passing air through the material either before, during or after treatment as is done in conventional prior art processes.

The entire one-step acid treatment process of the first embodiment requires from 1 to 30 minutes or more. Longer process times can also be utilized but are not necessary and are less economical. Preferably, the acid treatment time ranges from 5 to 25 minutes. Not included in the treatment time is the time required to initially heat the petroleum residua to treatment temperature.

In the process of the first embodiment, the softening point of the feed asphalt is substantially increased and the penetration is significantly decreased. The amount of increase in the softening point and decrease in penetration will vary greatly depending upon the properties of the feed and the amount of phosphoric acid used and the mixing temperature. Generally, it is desired to substantially increase the softening point by 50° F. to 120° F., preferably 70° F. to 100° F. and significantly lower the penetration at 77° F. by 20 to 80 dmm, preferably 30 to 60 dmm.

The product industrial asphalts of the first embodiment of the present invention will preferably have a softening point of 130° F. to 240° F., and more preferably 200° F. to 235° F. with a penetration at 77° F. from 10 to 70 dmm, preferably 12 to 30 dmm.

To further describe and to exemplify the first embodiment of the present invention, the following examples are presented. These examples are in no manner to be construed as limiting the present invention. In the following examples the viscosity was determined using ASTM D2170, the penetration by ASTM D5, and softening point by ASTM D2398. Each feed stock was tested for compatibility with phosphoric acid by mixing 100 grams of asphalt with 5 grams of 85 percent phosphoric acid at 450° F. for 15 minutes and then visually checking whether it separated into two phases. If it separated into two phases, it fails the test and will not form an industrial asphalt using the one-step process of the present invention.

EXAMPLES FOR THE FIRST EMBODIMENT OF THE INVENTION

Example 1

A 200-gram sample of a vacuum distilled asphalt from Boscan crude oil having a penetration at 77° F. of 91 dmm, a viscosity at 212° F. of 3587 cSt, a viscosity at 350° F. of 79 cSt, and a ring and ball softening point of 124° F., was heated to 325° F. with slow stirring and nitrogen injection. To the asphalt was slowly added 8.4 ml (13.3 g) of 75% phosphoric acid. Stirring speed was increased to about 850 rpm and the temperature was raised to 450° F. Stirring with nitrogen injection was continued for 20 minutes. The product had a penetration at 77° F. of 32 dmm, a viscosity at 350° F. of 946 cSt and a softening point of 201° F.

Example 2

The procedure of Example 1 was followed using other feed stocks or fluxes. Table I shows the effect of feed bituminous material composition and amount of phosphoric acid on the properties of the blended products. Bituminous materials from various sources are included in the table. In each case the addition of phosphoric acid raised softening points and viscosities and reduced penetrations.

Table II shows the effect of phosphoric acid strength. The amount of acid on a 100% $H_3PO_4$ basis was kept essentially constant. The viscosities at 350° F. increase with increasing acid strength whereas the penetrations and softening points are essentially unaffected by acid strength.

Table III shows the effects of blending temperatures and times. This data shows that the reaction is essentially completed within the first few minutes. However, these properties continue to change very slowly during 60 minutes of stirring. Higher softening points are obtained at higher blending temperatures.

Table IV compares the properties of two industrial asphalts based on the same type of feed flux. One of these was made by the process of the first embodiment of the present invention and the other by a conventional $FeCl_3$-catalyzed air-blowing process. One advantage of the process of the first embodiment is that substantially less diluent gas oil is required to produce the same industrial asphalt as determined by softening point and penetration. Furthermore, the phosphoric acid blended product of the first embodiment of present invention has the additional advantages of higher flash point and better weathering properties.

TABLE I

Effect of Asphalt Feed Composition On Properties of Blends With Phosphoric Acid

| Example | Feed Stock(1) | | | Phosphoric Acid | | Temp. | Product Properties | | |
|---|---|---|---|---|---|---|---|---|---|
| | | | | | | | Pen(2) | S.P.(3) | Vis.(4) |
| No. | Type | Vis.(4) | Acid Test(5) | Strength % | Wt. % | °F. | dmm | °F. | cSt |
| | Boscan | 79 | pass | — | 0 | — | 91 | 124 | 79 |
| 2 | Boscan | | | 75 | 6.7 | 450 | 32 | 201 | 946 |
| 3 | Boscan | | | 75 | 8.0 | 450 | 31 | 208 | 1735 |
| | Calif. | 80 | pass | — | 0 | — | 65 | 123 | 80 |
| 4 | Calif. | | | 85 | 5.9 | 450 | 18 | 215 | 1253 |
| 5 | Calif. | | | 85 | 7.0 | 450 | 16 | 229 | 2506 |
| | Gilsonite | 162 | pass | — | 0 | — | 43 | 142 | 162 |
| 6 | Gilsonite | | | 85 | 1.2 | 400 | 28 | 199 | 730 |
| 7 | Gilsonite | | | 85 | 2.9 | 400 | 15 | 243 | 5312 |
| | Pitch(6) | 105 | pass | — | 0 | — | 180 | 106 | 105 |
| 8 | Pitch | | | 85 | 7.0 | 450 | 16 | 200 | 1180 |
| | W. Texas(6) | 24 | fail | — | 0 | — | 350 | 90 | 24 |
| 9 | W. Texas(6) | | | 85 | 2.4 | 450 | >400 | 80 | 40 |
| | Alaskan | 46 | fail | — | 0 | — | 166 | 113 | 46 |
| 10 | Alaskan | | | 105 | 5.0 | 450 | 47 | 143 | 219 |
| | Arabian | 51 | fail | — | 0 | — | 206 | 108 | 51 |

TABLE I-continued

Effect of Asphalt Feed Composition On Properties of Blends With Phosphoric Acid

| Example No. | Feed Stock[1] Type | Vis.[4] | Acid Test[5] | Phosphoric Acid Strength % | Phosphoric Acid Wt. % | Temp. °F. | Product Properties Pen[2] dmm | S.P.[3] °F. | Vis.[4] cSt |
|---|---|---|---|---|---|---|---|---|---|
| 11 | Arabian | | | 85 | 5.9 | 450 | 204 | 110 | 136 |

[1]Feed stock description:
(a) Boscan = Boscan Distillation Residue
(b) Calif. = 75/25 California Coastal Crude Residue/Petroleum Gas Oil Distillate
(c) Gilsonite = 50/50 Gilsonite/Petroleum Gas Oil Distillate
(d) Pitch = 65/35 Solvent Deasphalted Pitch/Coconut Oil
(e) W. Texas = West Texas Crude Distillation Residue
(f) Alaskan = Alaskan North Slope Crude Distillation Residue
(g) Arabian = Arabian Light Crude Distillation Residue
[2]Penetration in decimillimeters (dmm) measured at 77° F.
[3]Softening point, using ring and ball technique
[4]Viscosity at 350° F. in centistokes (cSt)
[5]The 5% phosphoric acid test for compatibility
[6]Viscosity, penetration and softening points calculated from a viscosity-temperature plot.

TABLE II

Effect of Phosphoric Acid Strength
Feed Asphalt: 75/25 California Coastal Crude Residue/Petroleum Gas Oil Distillate

| Example No. | 11A | 12 | 13 | 14 | 15 | 16 |
|---|---|---|---|---|---|---|
| $H_3PO_4$ Strength, % | — | 50 | 87 | 100 | 105 | 115 |
| $H_3PO_4$, Wt. % | 0 | 10.0 | 5.8 | 5.0 | 4 4 | 4.1 |
| $H_3PO_4$ (100% Basis) Wt. % | — | 5.0 | 5.0 | 5.0 | 4.7 | 4.7 |
| Blend Temperature | — | 450 | 450 | 450 | 450 | 450 |
| Penetration at 77° F., dmm | 65 | 18 | 20 | 17 | 18 | 18 |
| Soft. Pt. (R&B) °F. | 123 | 226 | 224 | 232 | 225 | 247 |
| Viscosity, 350° F., cSt | 80 | 1643 | 1688 | 1894 | 1715 | 3155 |

TABLE III

Effect of Blending Time and Temperature
Feed Asphalt: 75/25 California Coastal Crude Residue/Petroleum Gas Oil Distillate
85% $H_3PO_4$, 6.5 wt. %

| Example No. | Blend Temp., °F. | Blend Time, Min. | Soft. Pt., °F. | Pen., 77° F., dmm | Vis., 350° F., cSt |
|---|---|---|---|---|---|
| 17 | 400 | 0[1] | 121 | 70 | 79 |
| | | 10 | 205 | 19 | 1288 |
| | | 20 | 208 | 17 | 1497 |
| | | 30 | 212 | 16 | 1578 |
| | | 40 | 214 | 16 | 1646 |
| | | 50 | 217 | 16 | 1769 |
| | | 60 | 219 | 15 | 1786 |
| 18 | 450 | 0[1] | 121 | 70 | 80 |
| | | 10 | 214 | 16 | 1669 |
| | | 20 | 217 | 15 | 1943 |
| | | 30 | 222 | 14 | 2099 |
| | | 40 | 224 | 14 | 2159 |
| | | 50 | 226 | 14 | 2312 |
| | | 60 | 228 | 14 | 2460 |
| 19 | 500 | 0[1] | 124 | 72 | 83 |
| | | 10 | 218 | 19 | 1570 |
| | | 20 | 223 | 17 | 1645 |
| | | 30 | 226 | 17 | 1817 |
| | | 40 | 228 | 16 | 1919 |
| | | 50 | 230 | 16 | 2096 |
| | | 60 | 232 | 16 | 2210 |

[1]Before acid addition

TABLE IV

Comparison of Air-Blown and Blended Industrial Asphalts Based on California Coastal Distillation Residue

| Process | Air-Blown | Blended |
|---|---|---|
| Example No. | 20 | 21 |
| Feed Asphalt Composition, Wt. % | 65 | 75 |
| California Coastal Distillation Residue | | |

TABLE IV-continued

Comparison of Air-Blown and Blended Industrial Asphalts Based on California Coastal Distillation Residue

| Process | Air-Blown | Blended |
|---|---|---|
| Petroleum Gas Oil | 35 | 25 |
| Distillate | 100 | 100 |
| Catalyst, Wt. % | | |
| $FeCl_3$ | 0.35 | — |
| 85% $H_3PO_4$ | — | 6.4 |
| Product Properties | | |
| Softening Point °F. | 223 | 228 |
| Penetration, dmm, °F. | | |
| 77 | 18 | 19 |
| 32 | 9 | 9 |
| 115 | 35 | 40 |
| Viscosity, 350° F., cSt | 2829 | 1800 |
| Ductility, 77° F., cm | 4.3 | 2.5 |
| Stain, S/H | 2.0 | 3.0 |
| Flash Point, COC, °F. | 490 | 525 |
| Weather-Ometer, Cycles to Failure | 62.9 | 160+ |

SECOND PREFERRED EMBODIMENT OF THE INVENTION

In a second embodiment of the present invention, product industrial asphalts are prepared by heating a mixture of green phosphoric acid and a bituminous material at an elevated temperature.

The Bituminous Materials

Bituminous materials for use in the second embodiment present invention can be of varied character. See, for example, "Bituminous Materials: Asphalts, Tars, and Pitches", Vol. I, A. J. Hoiberg, Editor, 1964, Interscience, pages 2–5, the disclosure of which is incorporated herein by reference. Many petroleum residua (also known as fluxes) remaining after the separation of vaporizable hydrocarbons from oil fractions, or any relatively high molecular weight extracts obtained from petroleum refining or from naturally occurring hydrocarbons (including tar and Gilsonite) can be used.

Particularly preferred bituminous materials include: petroleum distillation residua (vacuum distilled asphalt), a blend of hard petroleum distillation residua, a blend of Gilsonite, a blend of pitch from a solvent deasphalting process, a blend of pitch from a supercritical solvent deasphalting process. Any of the above blends can contain petroleum distillate or vegetable oil diluents. Generally the bituminous materials will have a viscosity at 350° F. of at least 50 cSt. Particularly preferred are bituminous materials (particularly vacuum distilled asphalt) having softening points in the range 100° to 200° F., preferably 110° to 150° F. and penetrations in the range 30 to 150 dmm, preferably 40 to 100 dmm at 77° F.

Green Phosphoric Acid

Green phosphoric acid is well known in the art and is readily available commercially. Green phosphoric acid is produced by the wet process which is well known in the art. The wet process is described in Kirk-Othmer, "Encyclopedia of Chemical Technology", Volume 17 (1982), pages 435–437, the disclosure of which is incorporated herein by reference. The wet process involves the digestion of phosphate rock with sulfuric acid followed by separation of a crude phosphoric acid from the calcium sulfate slurry by filtration. Green phosphoric acid is not only colored but also contains 1 to 5 and more commonly 2 to 3 percent other components. It is believed that these other components in green phosphoric acid interact in some manner with the acid and bituminous material causing the surprising results of the second embodiment of the present invention.

Many of the other components present in green phosphoric acid are well known and include sludge forming components of Fe, Al, Ca, Mg, Cu, F, Na, K, Si, and $SO_4$. A typical analysis of wet-process phosphoric acid is found in Kirk-Othmer, "Encyclopedia of Chemical Technology", Volume 17, page 435.

Green phosphoric acid is available in concentrations up to about 94 percent. Preferred for use in the second embodiment of the present invention is green phosphoric acid which has undergone little or no purification. Most preferred for use in the second embodiment of the present invention are green phosphoric acids having an $H_3PO_4$ equivalent in the range 52 to 94 percent and more preferably 70 to 90 percent. Preferred green phosphoric acids for use in the second embodiment of the present invention will assay as follows:

| Assay | Preferred Range, % | More Preferred, % |
|---|---|---|
| $P_2O_5$ | 37 to 70 | greater than 50.00 |
| CaO | 0.07 to 0.13 | greater than 0.1 |
| $Al_2O_3$ | 1.4 to 2.7 | greater than 2.0 |
| $Fe_2O_3$ | 0.6 to 1.2 | greater than 0.9 |
| MgO | 0.1 to 1.9 | greater than 1.4 |
| $K_2O$ | 0.07 to 0.13 | greater than 0.1 |
| $Na_2O$ | 0.07 to 0.13 | greater than 0.1 |
| $SiO_2$ | 0.2 to 0.3 | greater than 0.27 |
| $SO_4$ | 2.1 to 4.0 | greater than 3.0 |
| F | 0.5 to 0.9 | greater than 0.7 |

Water and minute amounts of other components make up the difference.

Processing Conditions

The bituminous material is mixed with 0.1 to 20.0 percent by weight, preferably 0.5 to 10.0 percent and more preferably 2.0 to 6.0 percent by weight of green phosphoric acid. The quantity of green phosphoric acid to be utilized in the second embodiment of the present invention is inversely proportional to the viscosity of the bituminous material. Thus, bituminous materials having low viscosities, e.g., about 60 cSt. at 350° F., require larger amounts of acid, e.g., about 8 percent. On the other hand, bituminous materials having high viscosities, e.g., about 200 cSt. at 350° F., need relatively lower amounts of acid, e.g., about 0.5 or 2 percent. Sufficient bituminous material is used in all instances to make up 100 percent by weight.

Other additives and other components may be present in the mixture. These additional components can be added to the mixture either before, during or after the treatment at the elevated temperature. One well known additional component is a lower boiling hydrocarbon particularly a lower boiling crude oil distillate boiling in the range of 500° to 1200° F. and preferably 680° to 1050° F. One such component is commonly known as gas oil. Generally such lower boiling hydrocarbons will be present in the range of 1 to 10 weight percent, and preferably 2 to 6 weight percent based on the weight of the bituminous material. The lower boiling hydrocarbon additive is sometimes referred to as a fluxing oil in the asphalt art.

The treating method of the second embodiment of the present invention comprises heating the bituminous material to a temperature in the range 200° F. to 800° F., preferably 350° F. to 550° F. to facilitate mixing and reaction with the green phosphoric acid.

After the starting material has been heated to a temperature sufficient for mixing purposes, at least above its softening point, the green phosphoric acid is most often introduced into the hot feed with continuous agitation. Agitation is usually supplied by mechanical means and must be adequate to disperse the phosphoric acid intimately throughout the asphalt. A preferred alternative process for mixing involves the use of in-line blending and a static mixer which further facilitate very short mixing and reaction time.

The acid treatment process of the second embodiment of the present invention requires from 1 to 1000 minutes or more. Longer process times can also be utilized but are not necessary and are less economical. Preferably, the acid treatment time ranges from 10 to 100 minutes. Not included in the treatment time is the time required to initially heat the bituminous material to treatment temperature.

Preferably, the product industrial asphalts of the second embodiment of the present invention are formed in a one-step process without any air-blowing or other oxidation treatment of the starting material prior to or after treatment with phosphoric acid.

More preferably the present method of treating bituminous materials does not include air-blowing of the feed stock during mixing or as a part of the treatment, the treatment being carried out without passing air through the material either before, during or after treatment as is done in conventional prior art processes.

In the process of the second embodiment of the present invention the physical properties of the bituminous material are modified. Generally the softening point of the feed bituminous material is substantially increased and the penetration is significantly decreased. The amount of increase in the softening point and decrease in penetration will vary greatly depending upon the properties of the feed and the amount of green phosphoric acid used and the mixing temperature. Generally, it is desired to substantially increase the softening point of the bituminous material by 50° F. to 120° F., preferably 70° F. to 100° F. and significantly lower the penetration at 77° F. by 20 to 80 dmm, preferably 30 to 60 dmm.

The Product Asphalts

The product industrial asphalts of the second preferred embodiment of the invention will preferably have a softening point of 130° to 245° F., preferably 200° to 240° F., and more still more preferably 215° F. to 230° F. with a penetration at 77° F. from 10 to 70 dmm, preferably 12 to 40 dmm and still more preferably 16 to 26 dmm.

EXAMPLES FOR THE SECOND PREFERRED EMBODIMENT

To further describe and to exemplify the present invention, the following examples are presented. These examples are in no manner to be construed as limiting the present invention.

EXAMPLES

In the following examples the viscosity was determined using ASTM D2170, the penetration by ASTM D5, and softening point by ASTM D2398.

Two samples of Santa Maria flux having a penetration of 58 dmm at 77° F., a viscosity of 7045 cSt at 212° F. and a softening point of 124° F. (before addition of fluxing oil), and containing 8 weight percent of a fluxing oil was added 5 parts per hundred of different phosphoric acids at 450° F. The type of acid, reaction time and the properties of the product are given in Table V below.

TABLE V

| | | Reaction Time, Min.: | | | | | |
|---|---|---|---|---|---|---|---|
| | | 50 | | 75 | | 100 | |
| Ex. | Phosphoric Acid Type | SP, °F. | Pen, dmm[1] | SP, °F. | Pen, dmm[1] | SP, °F. | Pen, dmm[1] |
| 1 | White, No Water | 199 | 23 | 205 | 21 | 214 | 19 |
| 2 | White, Aqueous | 197 | 23 | 203 | 21 | 210 | 19 |
| 3 | Green | 206 | 24 | 214 | 22 | 220 | 20 |

[1]at 77° F.

Comparison of Examples 1, 2 and 3 in Table V illustrates that green phosphoric acid provides surprising results in producing an industrial asphalt. Under comparable conditions, with green phosphoric acid one can produce an asphalt with a higher softening point and higher penetration than is possible with white phosphoric acid. Also, for a given softening point, one obtains a higher penetration asphalt using green phosphoric acid compared to the use of white phosphoric acid.

Other Features and Embodiments of the Invention

The process of the present invention can be utilized to produce industrial asphalts having surprisingly low viscosities. Asphalts produced by the process of the present invention have considerably lower viscosities for a given set of penetration and softening point properties than the same asphalts produced by conventional processes. Viscosities for conventional industrial asphalts range from about 5500 to 2500 Cst at 350° F., with typical values being between about 3000 to 5000 Cst at 350° F. Utilizing the present invention and particularly the green phosphoric acid embodiment of the present invention significantly lower viscosities can be obtained.

Generally it is preferred that the viscosities of the industrial asphalts of the present invention are less than 2500 Cst at 350° F., preferably less than 2000 Cst at 350° F. and most preferably less than 1800 Cst at 350° F. Low viscosity industrial asphalts made in accordance with the present invention will generally be in the range from about 3000 to 1000 Cst at 350° F., preferably 2000 to 1200 Cst at 350° F., and most preferably 1800 to 1400 Cst at 350° F.

These significantly lower viscosities are especially advantageous in subsequent processing of the industrial asphalt. For example, in preparing roofing shingle, faster processing rates or lower processing temperatures can be used. Moreover, additional quantities of low cost filler can be added, without exceeding processing limits due to excessively high viscosities.

In another embodiment of the invention, it has been found that asphalt prepared with phosphoric acid in accordance with the present invention is unique when filler materials are added to it. Fillers of use to the roofing industry are varied in composition and structure. Suitable fillers are described in several reports: California Journal of Mines and Geology, Vol. 47, No. 3, "Mineral Needs and Problems of the Bituminous Base Roofing Industry", Dozier Finley, 473–483, July 1951; and "Laboratory Evaluation of Six Selected Commercial Available Minerals as Stabilizers for Asphalt Roofing", NBS Report 2809, Sidney H. Greenfield, 49 pp. 1953. The disclosures of each of these two preceding reports are incorporated herein by reference.

Filler loading levels affect the durability of asphalt-filler mixtures in roofing products. The filler loading level also dramatically effects the cost of roofing products since asphalt is more costly than the filler. Filler loading levels and durability studies have been the subject of several reports, such as, "Natural Weathering of Mineral Stabilized Asphalt Coatings on Organic Felt", Sidney H. Greenfield, NBS Building Science Series 24, CODED: BSSNB, 17 pp., October 1969. This publication describes filler loading levels that range from 50 to 60% (wt.). Surprisingly higher filler loading levels of up to 75% are feasible using the industrial asphalts of the present invention. Such high filler level will depend on the viscosity of the unfilled asphalt and the viscosity of the filled mixture at temperatures approaching the flash point of the asphalt. Flash point is determined by the Cleveland Open Cup Method, ASTM D92.

Roofing shingles can be made using the industrial asphalts of the present invention comprising comprising 10 to 24 weight percent asphalt having a viscosity of less than 2500 Cst at 350° F. and 30 to 66 weight percent solid filler with the remainder of the shingle comprising mat, granules, sand backing and tabs.

It has been found that asphalts made with phosphoric acid in accordance with the present invention behave differently than conventional air blown asphalt on the addition of fillers in that the softening point of the filled system in the 50 to 60% filler range is lower than the softening point of the unfilled asphalt for the product of the green phosphoric acid embodiment of the invention. This is not the case for asphalts made by conventional air blowing. This unique feature of the industrial asphalt of the present invention made by the green phosphoric acid embodiment of the present invention makes possible considerably higher filler loading than could be achieved by the use of the same fillers in mixtures using conventional air blown asphalt. Filler mixtures of over 70% can be achieved with many of the asphalt-filler mixtures of the present invention. Table VIII below gives data on the filler type, loading level and softening point of filler mixtures using asphalt made by the green phosphoric acid embodiment of the present invention. Table VII gives a comparison of softening points for conventional air blown and ferric chloride catalyzed asphalts compared to asphalt made by treatment with green phosphoric acid for mixtures using trap rock as filler.

TABLE VII

Softening Points of Alaska North Slope Asphalt and Trap Rock Mixture

| Asphalt Description | Unfilled | Softening Point, °F. Trap Rock Content, Wt. % 59 | 60 | 63 | 70 |
|---|---|---|---|---|---|
| Air Blown | 228 | 241 | 241 | 253 | 284 |
| Air Blown/$FeCl_3$ Cat. | 221 | 241 | 241 | 253 | 284 |
| Green Phosphoric Acid | 222 | — | 206 | 211 | 213 |

TABLE VIII

Asphalt Filler Mixtures

| Filler Type | Loading Level, Wt. % | Softening Point, °F. |
|---|---|---|
| None | None | 222 |
| Dolomite | 60 | 180 |
| Dolomite | 71 | 208 |
| Greenstone | 60 | 188 |
| Greenstone | 71 | 214 |
| Silica | 60 | 212 |
| Silica | 65 | 220 |
| Limestone | 60 | 158 |
| Limestone | 73 | 192 |
| Limestone | 77 | 309 |

In another embodiment of the invention, it is preferred to purge with a gas during the reaction of the phosphoric acid with the bitumous material. Any one of a number of gases and/or steam can be used to purge the asphalt after admixture with the phosphoric acid. Useful purge gases include nitrogen, carbon dioxide, steam, methane, and fluorocarbons. Small amounts of oxygen can be present in the purge gases generally in the range of 0.1 to 4% by volume. However it is important that the oxygen content is substantially less than is present in air. These gases can be mixed, or used sequentially producing varying results.

The purge generally affects the asphalt's hardness and can also affect the rate at which the industrial asphalt is formed. Often less phosphoric acid is needed, if a purge stream is used during mixing.

The effect of a purge on the properties of an asphalt prepared by blending a flux with green phosphoric acid is shown in Table IX. When Flux A is blended with 5.0 parts per hundred ("PPH") green phosphoric acid at 450° F., the resulting asphalt had a softening point 197° F. and penetration of 27 dmm. This material cannot be used as an industrial asphalt. However, if that asphalt is purged for 2.5 hours at 450° F. with nitrogen, the asphalt's properties can be modified to a softening point of from 215° to 230° F. and a penetration of 24 to 22 dmm. The exact properties depend on the rate of the purge as shown in Table IX.

TABLE IX

The Effect of a 2.5-HR Purge on the Properties of Flux A[1] Blended with Phosphoric Acid[2]

| Purge Gas | Purge Rate SCFH/Gal. | Softening Point, °F. | Penetration at 77° F., dmm |
|---|---|---|---|
| None[3] | — | 197 | 27 |
| Nitrogen | 3.0 | 215 | 24 |
| Nitrogen | 5.0 | 223 | 23 |
| Nitrogen | 7.6 | 230 | 22 |

[1]Prior to blending with phosphoric acid, the softening point was 124° F., and the penetration at 77° F. was 56 dmm.
[2]5.0 PPH green phosphoric acid was used at 450° F.
[3]7.5 PPH green phosphoric acid is required in the absence of a purge to yield asphalt of softening point 219° F. and penetration at 77° F. of 22 dmm.

Alternately, the desired range of asphalt properties can also be achieved without purging the asphalt, but by substantially increasing the content of green phosphoric acid that is added to Flux A. The quantity of green phosphoric acid needed for Flux A to attain the desired properties is 7.5 PPH in the absence of a purge versus 5.0 PPH with the use of a purge.

Alternately, about 0.1 to 4% by volume oxygen can be added to the purge gas to shorten the purge time required to produce a product having a desired softening point. The oxygen can be added to the purge gas by mixing or blending the purge gas with air or pure oxygen in the appropriate ratio. Table X demonstrates the beneficial effect of 2.1% oxygen on the purge time required to produce an asphalt having a softening point of 218° F. As shown in the table, the purge time was reduced from 120 minutes to 60 minutes by addition of 2.1% oxygen to the nitrogen purge gas.

TABLE X

Effect of Purge Composition on Softening Point

| Purge Gas Composition, Vol. % Nitrogen | Oxygen | Purge Time, Min. To S.P. 218° F. (1) |
|---|---|---|
| 100 | 0 | 120 |
| 97.9 | 2.1 (2) | 60 |

(1) The S.P. was 187° F. prior at the start of the purge. Both reactions were carried out at 450° F. using 5.5 PPH green phosphoric acid and a AR4000W flux.
(2) Based on the use of 10% (volume) air in nitrogen. The composition of air includes 20.95% (volume) oxygen.

Particular preferred feedstocks that are useful in this invention are generally residua with high asphaltene contents, typically vacuum resids. The asphaltene content of the resid is preferably greater than about 5% as measured by the weight of insoluble material obtained upon extraction with hot heptanes at 80° C. More preferably, the asphaltene content is greater than about 12%; naphthenic crudes and resids are preferred, while paraffinic, waxy crudes and resids are not desirable.

For example, residua from the following crudes are generally useful in this process: Maya, Boscan, Venezuela crudes, and Santa Maria and Arab Heavy.

Residua from the following crudes are not generally useful in the process of the present invention: Altamount, Alaskan North Slope Blend, Whittier, and Uinta.

Resid with low asphaltene contents can be used if blended with resids having high asphaltene contents. The blended resids should have at least about 12% asphaltenes. For example, a blend of 35% Santa Maria and 65% ANS gives industrial asphalts using the process of this invention.

Generally, producing industrial asphalts by the process of this invention does not require a softening oil, as is necessary with many hard asphaltic materials when treated by conventional air blowing technology.

Phosphorus is present in the product industrial asphalts of the present invention. Various methods can be utilized for determining the amount of phosphorus in the product. One preferred method is by microprobe analysis described below.

A sample of the produced asphalt was cooled to −75° C. and fractured by inflicting a sharp blow to produce samples with smooth surfaces. These samples were analyzed at 15 points along the surface for phosphorus. It was found that the phosphorus was uniformly dispersed throughout the sample. The average phosphorus concentration of the sample was 1.99%. This corresponds to a calculated value of phosphoric acid of 6.4 wt % versus the amount of phosphoric acid added, which was 6.4 wt %.

The green phosphoric acid used to make asphalt by the process of this invention also contains other materials, one of these is fluorine, which is present together with phosphorous in the mineral used to make the green acid as defined earlier. Fluorine contents in green phosphoric acid range from about 0.5 to 1.2 wt %, at 52 wt % $P_2O_5$. More typically, the fluorine content is about 0.7 to 0.9 wt %, at 52 wt % $P_2O_5$.

The product industrial asphalt can also analyzed for fluorine Typical results by neutron activation gave 0.074% fluorine, consistent with the amount of green phosphoric acid added. The fluorine present in the asphalt made using green phosphoric acid is characterized by a fluorine to phosphorous ratio which may vary depending on the content of fluorine and phosphorous present in the source mineral from which the green acid was derived, and other variables which may be related to the process that produced the green phosphoric acid. The fluorine to phosphorous ratio in the asphalt made by the use of green phosphoric acid is about 7 to 15 to 1 to 100, more typically about 1:30.

As will be evident to those skilled in the art, various modifications of this invention can be made or followed, in light of the foregoing disclosure and discussion, without departing from the spirit or scope of the disclosure or from the scope of the following claims.

What is claimed is:

1. A one-step method of producing an industrial asphalt from a bituminous material which comprises mixing together without air-blowing either before, during, or after said mixing;
   a. a feed material comprising a bituminous material having a viscosity of at least 50 centistokes at 350° F. and wherein the feed bituminous material forms a single phase when mixed with 5 percent of 85 percent phosphoric acid; and
   b. from about 0.1 to 20.0 percent by weight of phosphoric acid having an $H_3PO_4$ equivalent of less than 100 percent, said mixing being done at a temperature in the range of 351° to 600° F., whereby the softening point of the feed is substantially increased by 70° F. to 100° F. and the penetration is significantly decreased by 30 to 60 dmm at 77° F. thereby producing an industrial asphalt having a softening point in the range 200° to 235° F. and a penetration in the range 12 to 30 dmm at 77° F.

2. The method of claim 1 wherein said mixing is carried out in 5 to 25 minutes.

3. The method of claim 2 wherein the amount of phosphoric acid is in the range of 0.5 to 10 percent by weight.

4. A one-step method of producing an industrial asphalt from a petroleum residuum which comprises mixing together without air-blowing either before, during, or after said mixing:
   a. a feed comprising a petroleum residuum having a viscosity of 65 to 180 centistokes at 350° F. and wherein said feed forms a single phase when mixed with 5 percent of 85 percent phosphoric acid; and
   b. from more than 0.5 to less than 8 percent by weight of an aqueous phosphoric acid having an $H_3PO_4$ equivalent of less than 100 percent, said mixing being done at a temperature in the range of 400° F. to 500° F. for from 5 to 25 minutes; whereby the softening point of the asphalt is substantially increased by 70° F. to 100° F. and the penetration is significantly decreased by at least 30 to 60 dmm at 77° F. thereby producing an industrial asphalt having a softening point in the range 200° F. to 235° F. and a penetration of 12 to 30 dmm at 77° F.

5. A method for modifying the physical properties of a bituminous material which comprises heating at an elevated temperature a mixture comprising:
   a. from about 0.1 to 20.0 percent by weight green phosphoric acid, and
   b. a bituminous material to make up 100 percent by weight, said bituminous material comprising vacuum distilled asphalt.

6. The method of claim 5 wherein said green phosphoric acid is made from the digestion of phosphate rock with sulfuric acid.

7. The method of claim 6 wherein said elevated temperature is in the range of 200° to 800° F.

8. The method of claim 7 wherein the softening point of said bituminous material is increased by 50° to 120° F. and the penetration is decreased by 20 to 80 dmm.

9. The method of claim 8 wherein the softening point of said bituminous material is increased by 70° F. to 100° F. and the penetration is decreased by 30 to 60 dmm.

10. The method of claim 9 wherein said elevated temperature is in the range of 350° to 550° F.

11. The method of claim 10 wherein the amount of green phosphoric acid is in the range of 0.5 to 10 percent by weight.

12. The method of claim 11 wherein the physical properties of said bituminous material are modified producing an industrial asphalt having a softening point in the range 130° F. to 245° F. and a penetration in the range 10 to 70 dmm at 77° F.

13. The method of claim 11 wherein the physical properties of said bituminous material are modified producing an industrial asphalt having a softening point in the range 200° to 240° F. and a penetration in the range 12 to 40 dmm at 77° F.

14. A one-step method of producing an industrial asphalt from vacuum distilled asphalt which comprises heating at an elevated temperature without air-blowing a mixture comprising:
   a. from about 0.5 to 10.0 percent by weight green phosphoric acid, and
   b. a bituminous material to make up 100 percent by weight, said bituminous material comprising vacuum distilled asphalt having a viscosity of at least 50 cSt at 350° F. and a softening point in the range 110° to 150° F. and a penetration of 40 to 100 dmm, thereby producing an industrial grade asphalt.

15. The process of claim 14 wherein said green phosphoric acid assays:

$P_2O_5$, greater than 50.00%;

CaO, greater than 0.1;
$Al_2O_3$, greater than 2.0;
$Fe_2O_3$, greater than 0.9;
MgO, greater than 1.4;
$K_2O$, greater than 0.1;
$Na_2O$, greater than 0.1;
$SiO_2$, greater than 0.27;
$SO_4$, greater than 3.00; and
F, greater than 0.7.

16. A method for modifying the physical properties of a bituminous material which comprises heating at an elevated temperature a mixture comprising:

a. from about 0.1 to 20.0 percent by weight green phosphoric acid, and b. a bituminous material to make up 100 percent by weight, said bituminous material comprising asphalt.

17. A one-step method of producing an industrial asphalt from a bituminous material which comprises mixing together without air-blowing:

a. a feed material comprising a petroleum residuum having a viscosity of at least 50 centistokes at 350° F. and wherein the feed petroleum residuum forms a single phase when mixed with 5 percent of 85 percent phosphoric acid; and b. from about 0.1 to 20.0 percent by weight of phosphoric acid, said mixing being done at a temperature in the range of 351° to 600° F., whereby the softening point of the feed is substantially increased and the penetration is significantly decreased.

* * * * *